US005620942A

United States Patent [19]

Kung et al.

[11] Patent Number: 5,620,942

[45] Date of Patent: Apr. 15, 1997

[54] OVERCOAT FOR THERMAL DYE TRANSFER RECEIVING ELEMENT

[75] Inventors: Teh-Ming Kung, Rochester; David B. Bailey, Webster; Brian T. Pope, Penfield, all of N.Y.

[73] Assignee: Eastman Kodak Company, Rochester, N.Y.

[21] Appl. No.: 664,030

[22] Filed: Jun. 13, 1996

[51] Int. Cl.[6] ..... B41M 5/035; B41M 5/38

[52] U.S. Cl. ..... 503/227; 428/195; 428/412; 428/447; 428/913; 428/914

[58] Field of Search ..... 8/471; 428/195, 428/412, 447, 913, 914; 503/227

[56] References Cited

U.S. PATENT DOCUMENTS

| | | | |
|---|---|---|---|
| 4,927,803 | 5/1990 | Bailey et al. | 503/227 |
| 5,369,077 | 11/1994 | Harrison et al. | 503/227 |

*Primary Examiner*—B. Hamilton Hess
*Attorney, Agent, or Firm*—Harold E. Cole

[57] ABSTRACT

A dye-receiving element for thermal dye transfer comprising a support having on one side thereof, in order, a dye image-receiving layer and an overcoat layer thereon, the overcoat layer comprising:

a) a linear condensation copolymer containing block polysiloxane units copolymerized into a linear polymer chain, the linear copolymer comprising from about 1 to about 40 wt. % of polysiloxane units; and b) a polycarbonate having a Tg of from about 10° C. to about 120° C. and a molecular weight of from about 1,000 to about 6,000, said polycarbonate having the following formula:

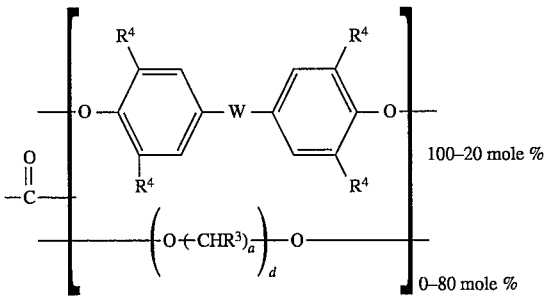

wherein $R^3$ represents hydrogen, methyl or ethyl;

$R^4$ repesents hydrogen, alkyl of 1 to 6 carbon atoms or halogen;

a represents an integer from 2 to 10;

d is an integer from 1 to 6; and

W represents

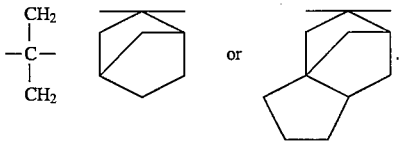

20 Claims, No Drawings

OVERCOAT FOR THERMAL DYE TRANSFER RECEIVING ELEMENT

This invention relates to dye-receiving elements used in thermal dye transfer, and more particularly to an overcoat layer for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen for its compatibility and receptivity for the dyes to be transferred from the dye-donor element.

U.S. Pat. No. 5,369,077 relates to a thermal dye transfer receiving element which comprises a linear condensation copolymer containing block polysiloxane units copolymerized into a linear polymer chain. There is a problem with these receiver elements in that they tend to get scratches due to regular handling. Scratches can be readily produced when the antistat backcoat surface of a thermal dye transfer receiver element comes into contact with the topcoat surface of another element (where the imaged dyes reside). Additional scratches and abrasions are produced when some relative motion of the two surfaces takes place during such contact. The scratches, which may not be seen easily by the naked eye, become sites to induce or promote undesirable dye crystallization and subsequent dye loss of the transferred dyes in such imaged thermal dye transfer receiving elements.

Accordingly, it is an object of this invention to provide a dye-receiver element for a thermal dye transfer process having excellent dye uptake and image stability. It is another object of this invention to provide a dye-receiving element which would have improved resistance to dye crystallization and subsequent dye loss.

These and other objects are achieved in accordance with this invention which comprises a dye-receiving element for thermal dye transfer comprising a support having on one side thereof, in order, a dye image-receiving layer and an overcoat layer thereon, the overcoat layer comprising:

a) a linear condensation copolymer containing block polysiloxane units copolymerized into a linear polymer chain, the linear copolymer comprising from about 1 to about 40 wt. % of polysiloxane units; and b) a polycarbonate having a Tg of from about 10° C. to about 120° C. and a molecular weight of from about 1,000 to about 6,000, said polycarbonate having the following formula:

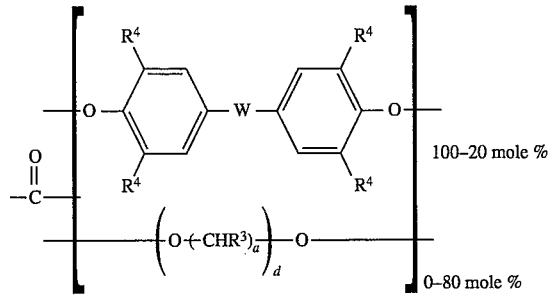

wherein $R^3$ represents hydrogen, methyl or ethyl;

$R^4$ repesents hydrogen, alkyl of 1 to 6 carbon atoms or halogen;

a represents an integer from 2 to 10;

d is an integer from 1 to 6; and

W represents

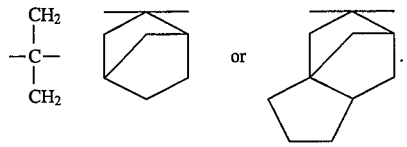

For further details of polycarbonates useful in the invention, reference is made to U.S. Pat. No. 4,927,803, the disclosure of which is hereby incorporated by reference.

Specific examples of polycarbonates employed in the invention include the following:

Polycarbonate 1: A bisphenol-A polycarbonate modified with 50 mole % 3-oxa-1,5-pentanediol, Tg=32° C. and M.W. ~2,200.

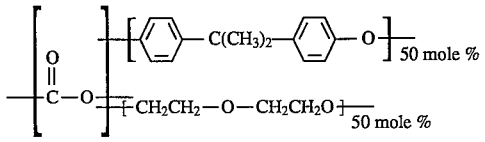

Polycarbonate 2: A bisphenol-A polycarbonate modified with 50 mole % 3-oxa-1,5-pentanediol, Tg=30° C. and M.W. ~3,000.

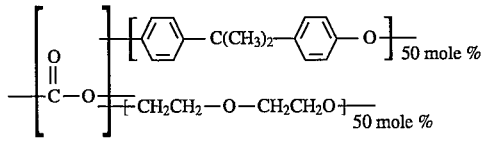

Polycarbonate 3: A bisphenol-A polycarbonate modified with 50 mole % 3-oxa-1,5-pentanediol, Tg=35° C. and M.W. ~5,600.

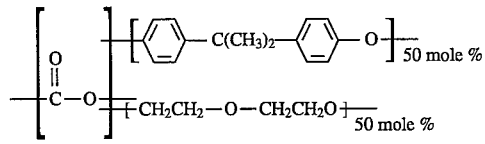

Polycarbonate 4: A bisphenol-A polycarbonate modified with 50 mole % 3-oxa-1,5-pentanediol, Tg=33° C. and M.W. ~2,500.

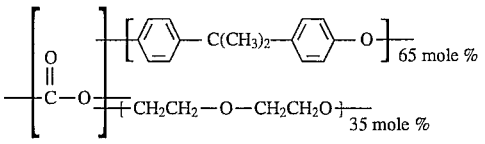

Polycarbonate 5: A bisphenol-A polycarbonate modified with 25 mole % 4,4'-(octahydro-4,7- methano-5H-indene-5-ylidene) bisphenol and 50 mole % 3-oxa-1,5-pentanediol, Tg=53° C. and M.W. ~2,000.

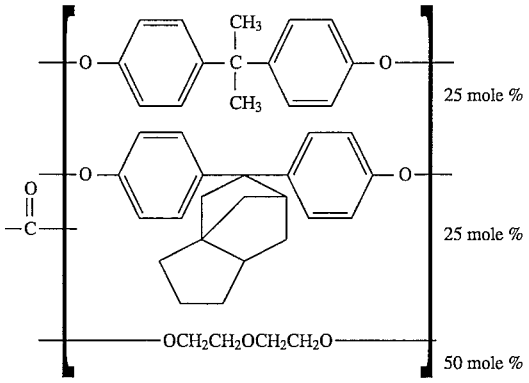

Polycarbonate 6: A bisphenol-A polycarbonate modified with 25 mole % 4,4'-(octahydro-4,7- methano-5H-indene-5-ylidene) bisphenol and 50 mole % 3-oxa-1,5-pentanediol, Tg=51° C. and M.W. ~2,900.

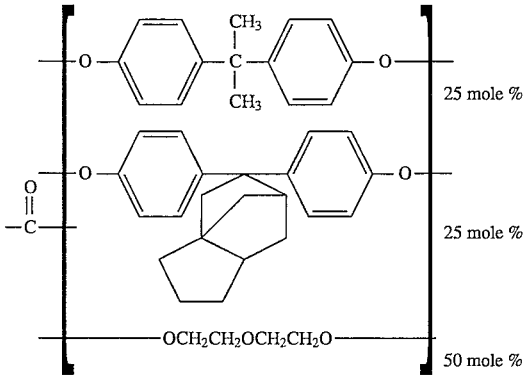

In a preferred embodiment of the invention, $R^3$ and $R^4$ in the above general formula for the polycarbonates are both hydrogen, a is 2 and d is 2. In another preferred embodiment, W is $—C(CH_3)_2—$. In still another preferred embodiment, the ratio of said linear condensation copolymer to said polycarbonate is from about 5:1 to about 1:5.

The linear condensation copolymer described above containing block polysiloxane units may be formed by copolymerizing polysiloxane block units which become much more resistant to dye-donor sticking. These properties make such linear copolymers ideally suited for use in a receiver overcoat. copolymers are readily manufacturable, and do not require any post coating curing steps to bond siloxanes to a main polymer chain.

To obtain linear condensation copolymer described above containing block polysiloxane units, monomer units which form, for example, polycarbonates upon condensation may be copolymerized with functional group terminated polysiloxanes of the general formula (I):

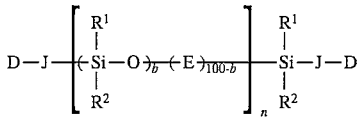

(I)

wherein:

$R^1$ and $R^2$ are each independently substituted or unsubstituted alkyl of from about 1 to 6 carbon atoms (preferably a methyl group or a fluoro substituted alkyl group), or substituted or unsubstituted phenyl, with the proviso that $R^1$ and $R^2$ are not both phenyl;

J is a bivalent linking group (preferably $—(CH_2)_p—$ where p is 1 to 10);

D is amino, hydroxyl, or thiol;

E represents optional second siloxane units which may be diphenyl substituted, or oxyalkylene containing units;

b represents 50 to 100 mole percent; and n is chosen such as to provide a molecular weight of from about 1,000 to 30,000 (preferably 1,000 to 15,000) for the polysiloxane block unit.

Preferred linear condensation copolymers described above containing block polysiloxane units are of the following general structure (II):

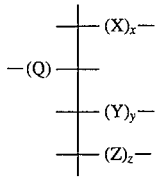

(II)

wherein:

Q represents a linkage unit which together with units X, Y and Z form an ester-type linkage unit;

X is derived from one or more non-phenolic diol units, present at x=0 to 99.9 mole %;

Y is derived from an aromatic diphenolic unit, present at y=0 to 99.9 mole %;

Z is derived from a functional group terminated polysiloxane as described above present at z=0.1 to 10.0 mole %, preferably 0.2 to 4.0 mole %; and x+y+z=100.

Ester units may be formed by condensing an aliphatic or aromatic dibasic acid with diol (such as X1 through X8 illustrated below) or diphenolic (such as bisphenols Y1 through Y5 illustrated below) units to form a polyester. Amide units may similarly be formed by condensing a diisocyanate with diol or diphenolic units to form a polyurethane. Carbonate units may be formed by condensing a chloroformate or phosgene with diol or diphenolic units to form a polycarbonate. The term "polycarbonate" as used herein means a polyester of carbonic acid and a diol or diphenol.

When Q is carbonate, X and Y are preferred at a molar ratio of from about 3:1 to about 1:3.

Specific examples of aliphatic non-phenolic glycols that may be copolymerized include X1 through X8:

| | |
|---|---|
| X1: $HOCH_2CH_2OH$ | ethylene glycol |
| X2: $HO(CH_2)_3OH$ | 1,3-propanediol |
| X3: $HO(CH_2)_4OH$ | 1,4-butanediol |
| X4: $HO(CH_2)_5OH$ | 1,5-pentanediol |
| X5: $HO(CH_2)_9OH$ | 1,9-nonanediol |
| X6: $O(CH_2CH_2OH)_2$ | diethylene glycol |
| X7: $HOCH_2C(CH_3)_2CH_2OH$ | neopentyl glycol |
| X8: $HO(CH_2CH_2O)_{20-70}H$ | polyethylene glycol |

Specific examples of aromatic bisphenols that may be copolymerized include Y1 through Y5:

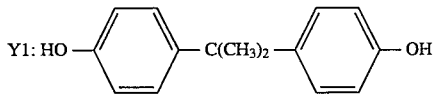

bisphenol-A

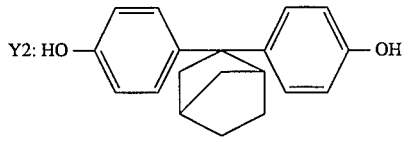

4,4'-bicyclo[2.2.2]hept-2-ylidenebisphenol

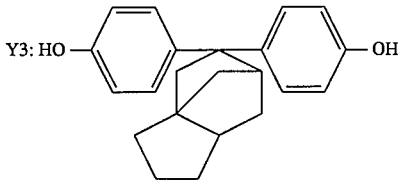

4,4'-(octahydro-4,7-methano-5H-indene-5-ylidene)bisphenol

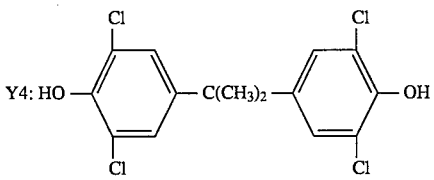

tetrachlorobisphenol-A

-continued

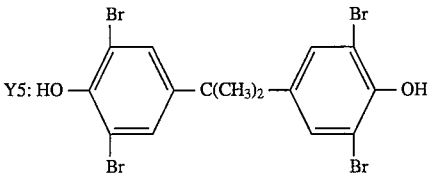

tetrabromobisphenol-A

Specific examples of siloxanes that may be copolymerized include Z1 through Z8:

Z1: $H_2N(CH_2)_3\text{-}(Si(CH_3)_2O)_n\text{-}Si(CH_3)_2(CH_2)_3NH_2$

Z2: $HO(CH_2)_2\text{-}(Si(CH_3)_2O)_n\text{-}Si(CH_3)_2(CH_2)_2OH$

Z3: $HS(CH_2)_{10}\text{-}(Si(CH_3)_2O)_n\text{-}Si(CH_3)_2(CH_2)_{10}SH$

Z4: $H_2N(CH_2)_4\text{-}(Si(CH_3)(C_6H_5)O)_n\text{-}Si(CH_3)(CH_6H_5)(CH_2)_4NH_2$ Z5: $H_2N(CH_2)_3\text{-}(Si(CH_3)(CH_2CF_3)O)_n\text{-}Si(CH_3)_2(CH_2)_3NH_2$ Z6: $H_2N(CH_2)_3\text{-}[(Si(CH_3)_2O)_b\text{-}(Si(C_6H_5)_2O)_{100-b}]_n\text{-}Si(CH_3)_2(CH_2)_3NH_2$ Z7: $H_2N(CH_2)_6\text{-}[(Si(CH_3)_2O)_b\text{-}(CH_2CH_2O)_{100-b}]_n\text{-}Si(CH_3)_2(CH_2)_6NH_2$ Z8: $HOCH_2\text{-}\left[(Si(CH_3)_2O)_b\left(Si(CH_3)O\text{-}\underset{\underset{(Si(CH_3)_2O)_m\text{-}Si(CH_3)_3}{|}}{\overset{O}{|}}\right)_{100-b}\right]_n\text{-}CH_2OH$ Wherein m and n are each 20 to 200, and b is 50 to 100 mole %. Specific values for m, n, and b am set forth in the polymer listings below.

These siloxane block units should represent 0.1 to 10.0 mole %, preferably 0.2 to 4.0 mole %, of the final polymer. The mole percentage of the siloxane block unit in the final polymer should be selected based upon the molecular weight of the siloxane block in order to generate a copolymer comprising from about 1 to about 40 wt % of siloxane block units, preferably from about 3 to about 30 wt %. Above about 40 wt % siloxane, problems occur with incorporation of the siloxane blocks into the linear polymer chain, while below 1 wt % siloxane, release between the dye-donor and receiver is not as facilitated as desired.

The support for the dye-receiving element of the invention may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5.096,875, the disclosures of which are incorporated by reference.

Receiving layer polymers employed in the invention include polycarbonates, polyurethanes, polyesters, polyvinyl chlorides, poly(styrene-co-acrylonitrile), polycaprolactone or any other receiver polymer and mixtures thereof. In a preferred embodiment, the dye image-receiving layer comprises a polycarbonate. Preferred polycarbonates include bisphenol-A polycarbonates having a number average molecular weight of at least about 25,000. Examples of such polycarbonates include General Electric LEXAN® Polycarbonate Resin, Bayer AG MACROLON 5700®, and the polycarbonates disclosed in U.S. Pat. No. 4,927,803, the disclosure of which is incorporated by reference.

The dye image-receiving and overcoat layers may be present in any amount which is effective for their intended purposes. In general, good results have been obtained at a receiver layer concentration of from about 1 to about 10 $g/m^2$ and an overcoat layer concentration of from about 0.01 to about 3.0 $g/m^2$, preferably from about 0.1 to about 1 $g/m^2$.

Dye-donor elements that are used with the dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to further illustrate the invention.

EXAMPLE

The following polymers were employed in the example:

P-1: a polycarbonate random terpolymer of bisphenol-A (50 mole % ), diethylene glycol (93.5 wt %) (avg. mol. wt. 100,000) and polydimethylsiloxane (6.5 wt. %) (2500 mol. wt.) block units (50% mole %).

P-2: low mol. wt. (about 2,000) version of polycarbonate random copolymer of bisphenol-A (50 mole-%) and diethylene glycol (50 mole-%) which is end-capped with hydroxyl functional groups.

P-3: low mol. wt. (about 2,000) version of polycarbonate random copolymer of bisphenol-A (50 mole-%) and diethylene glycol (50 mole-%) which is end-capped with ester functional groups.

P-4: high mol. wt. (about 100,000) version of polycarbonate random copolymer of bisphenol-A (50 mole-%) and diethylene glycol (50 mole-%).

P-5: polyether glycol, Terathane® 2000 (Du Pont Co.).

A dye-receiving element base was prepared employing a support laminated to a packaging film. The support consisted of a paper stock from a blend of Pontiac Maple 51 (a bleached maple hardwood kraft of 0.5 μm length weighted average fiber length) available from Consolidated Pontiac, Inc. and Alpha Hardwood Sulfite (a bleached red-alder hardwood sulfite pulp of 0.69 μm average fiber length) available from Weyerhauser Paper Co. This support had a microvoided packaging film of OPPalyte® 350 TWK, polypropylene-laminated paper support with a lightly $TiO_2$-pigmented polypropylene skin (Mobil Chemical Co.) at a dry coverage of 0.11 $g/m^2$, 36 μm thick, laminated on the imaging side. Prior to coating, the support was subjected to a corona discharge treatment at approximately 450 joules/$m^2$.

Control 1

This thermal dye-transfer receiving element was prepared from the above receiver support by coating the following layers in order on the top surface of the microvoided packaging film:

a) a subbing layer of Prosil® 221 and Prosil® 2210 (PCR, Inc.) (1:1 weight ratio) both are organo-oxysilanes, in an ethanol-methanol-water solvent mixture. The resultant solution (0.10 $g/m^2$) contained approximately 1% of silane component, 1% water, and 98% of 3A alcohol;

b) a dye-receiving layer containing Makrolon® KL3-1013 (a polyether-modified bisphenol-A polycarbonate block copolymer) (Bayer AG) (1.82 $g/m^2$), GE Lexan® 141-112 (a bisphenol-A polycarbonate) (General Electric Co.) (1.49 $g/m^2$), and Fluorad® FC-431 (perfluorinated alkylsulfonamidoalkyl ester surfactant) (3M Co.) (0.011 $g/m^2$), di-n-butyl phthalate (0.33 $g/m^2$), and diphenyl phthalate (0.33 $g/m^2$) and coated from a solvent mixture of methylene chloride and trichloroethylene (4:1 by weight) (4.1% solids); and c) a dye-receiver overcoat containing a solvent mixture of methylene chloride and trichloroethylene; P-1 (0.66 $g/m^2$), and surfactants DC-510 Silicone Fluid (Dow-Corning Corp.) (0.008 $g/m^2$) and Fluorad® FC-431 (3M Co.) (0.016 $g/m^2$) from dichloromethane.

Control 2

This is similar to Control 1 except that P-1 was employed at 0.55 g/m$^2$ along with P-4 at 0.11 g/m$^2$. The polycarbonate has a molecular weight of about 100,000.

Control 3

This is similar to Control 1 except that P-1 was employed at 0.33 g/m$^2$ along with P-4 at 0.33 g/m$^2$. The polycarbonate has a molecular weight of about 100,000.

Control 4

This is similar to Control 1 except that instead of P-1, P-4 was employed at 0.66 g/m$^2$. The polycarbonate has a molecular weight of about 100,000.

Control 5

This is similar to Control 1 except that P-1 was employed at 0.33 g/m$^2$ along with P-5 at 0.33 g/m$^2$. The polymer was a polyether glycol having a molecular weight of about 2000, and not a polycarbonate.

Control 6

This is similar to Control 1 except that instead of P-1, P-5 was employed m 0.66 g/m$^2$. The polymer was a polyether glycol having a molecular weight of about 2000, and not a polycarbonate.

Control 7

This is similar to Control 1 except that instead of P-1, P-2 was employed at 0.66 g/m$^2$. The polycarbonate has a molecular weight of about 2,000, but had no polysiloxane.

Invention Example 1

This is similar to Control 1 except that P-1 was employed at 0.55 g/m$^2$ along with P-2 at 0.11 g/m$^2$.

Invention Example 2

This is similar to Control 1 except that P-1 was employed at 0.33 g/m$^2$ along with P-2 at 0.33 g/m$^2$.

Invention Example 3

This is similar to Control 1 except that P-1 was employed at 0.33 g/m$^2$ along with P-3 at 0.33 g/m$^2$.

A dye-donor element was prepared similar to that of the Example in U.S. Pat. No. 5,514,637, except that only the magenta dye patch was used. The above dye-receiving elements and dye-donor elements were processed in the commercially-available XLS-8600 Printer made by Eastman Kodak Company. The printer had been modified to prim at 5 ms per line.

The thermal dye transfer receiving elements were subject to a specially designed scratch-induced dye crystallization experiment. Scratches were produced by using a receiver backcoat as described in U.S. Pat. No. 5,198,408 which was adhered to the flat end of a cylindrical brass block of 170 grams in weight. The end of the brass block with the receiver backcoat on it was placed against the surface of the imaged receiver with a gradation of density patches (OD ranging from 0.2 through 1.2) of transferred magenta dyes. The brass block was then run across the density patches at a traveling speed of about 0.06 m/s for all samples. The scratched receivers were then subjected to two different dark keeping conditions: 21° C., 50% RH for four weeks and 40° C, 40% RH for two weeks The results of scratch-induced dye crystallization and subsequent dye loss of the transferred dyes in the printed (or imaged) thermal dye transfer receiving elements were evaluated qualitatively and ranked into six categories, i.e., 1—no dye crystals or dye loss observed 2—very slight amount of dye crystals or dye loss observed 3—noticeable dye crystals or dye loss observed 4—obvious dye crystals or dye loss observed 5—gross dye crystals or dye loss observed 5+—massive dye crystals or dye loss observed plus additional image defects, such as image smearing.

The following results were obtained:

TABLE

| Example | Polycarbonate (g/m$^2$) | Dye Crystallization/ Dye Loss Four Weeks | Dye Crystallization/ Dye Loss Two Weeks |
|---|---|---|---|
| Control 1 | P-1 (0.66) | 3 | 3 |
| Control 2 | P-1(0.55)/P-4 (0.11) | 4 | 4 |
| Control 3 | P-1(0.33)/P-4 (0.33) | 4 | 4 |
| Control 4 | P-4 (0.66) | 3 | 4 |
| Control 5 | P-1(0.55)/P-5 (0.11) | 5+ | 5+ |
| Control 6 | P-1(0.33)/P-5 (0.33) | 5+ | 5+ |
| Control 7 | P-5 (0.66) | 4 | 1 |
| Invention 1 | P-1(0.55)/P-2 (0.11) | 3 | 2–3 |
| Invention 2 | P-1(0.33)/P-2 (0.33) | 2 | 2 |
| Invention 3 | P-1(0.33)/P-3 (0.33) | 1–2 | 1 |

The above results show that the invention receivers overall had better resistance to dye crystallization than the control receivers.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on one side thereof, in order, a dye image-receiving layer and an overcoat layer thereon, said overcoat layer comprising:

a) a linear condensation copolymer containing block polysiloxane units copolymerized into a linear polymer chain, said linear copolymer comprising from about 1 to about 40 wt. % of polysiloxane units; and b) a polycarbonate having a Tg of from about 10° C. to about 120° C. and a molecular weight of from about 1,000 to about 6,000, said polycarbonate having the following formula:

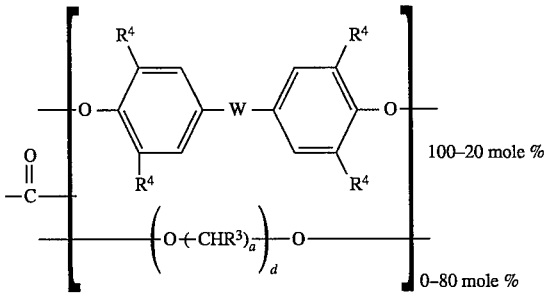

wherein $R^3$ represents hydrogen, methyl or ethyl;

$R^4$ repesents hydrogen, alkyl of 1 to 6 carbon atoms or halogen;

a represents an integer from 2 to 10;

d is an integer from 1 to 6; and w represents

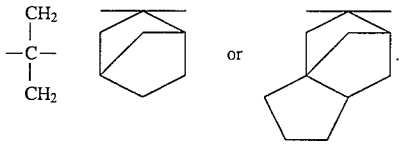

2. The element of claim 1 wherein the block polysiloxane units of the linear condensation copolymer are derived from functional group terminated polysiloxanes of the following formula (I):

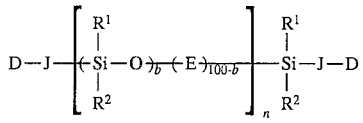

(I)

wherein:

$R^1$ and $R^2$ are each independently substituted or unsubstituted alkyl of from 1 to 6 carbon atoms, or substituted or unsubstituted phenyl, with the proviso that $R^1$ and $R^2$ are not both phenyl;

J is a bivalent linking group;

D is amino, hydroxyl, or thiol;

E represents optional second siloxane units which may be diphenyl substituted or oxyalkylene containing units;

b represents 50 to 100 mole percent; and n is chosen such as to provide a molecular weight of from about 1,000 to 30,000 for the polysiloxane block unit.

3. The element of claim 2 wherein said linear condensation copolymer is of the following formula (II):

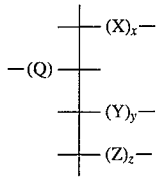

(II)

wherein:

Q represents linkage units which together with units X, Y and Z from ester type linkage units or amide type linkage units;

X is derived from one or more non-phenolic diol units, present at x=0 to 99.9 mole %;

Y is derived from an aromatic diphenolic unit, present at y=0 to 99.9 mole %;

Z is derived from the polysiloxane of formula (I) present at z=0.1 to 10.0 mole %; and x+y+z=100.

4. The element of claim 3 wherein the linear condensation copolymer is a polycarbonate.

5. The element of claim 1 wherein $R^3$ and $R^4$ are both hydrogen, a is 2 and d is 2.

6. The element of claim 1 wherein W is $—C(CH_3)_2—$.

7. The element of claim 1 wherein the ratio of said linear condensation copolymer to said polycarbonate is from about 5:1 to about 1:5.

8. A process of forming a dye transfer image comprising imagewise-heating a dye-donor element comprising a support having thereon a dye layer and transferring a dye image to a dye-receiving element to form said dye transfer image, said dye-receiving element comprising a support having thereon, in order, a dye image-receiving layer and an overcoat layer, said overcoat layer comprising:

a) a linear condensation copolymer containing block polysiloxane units copolymerized into a linear polymer chain, said linear copolymer comprising from about 1 to about 40 wt. % of polysiloxane units; and b) a polycarbonate having a Tg of from about 10° C. to about 120° C. and a molecular weight of from about 1,000 to about 6,000, said polycarbonate having the following formula:

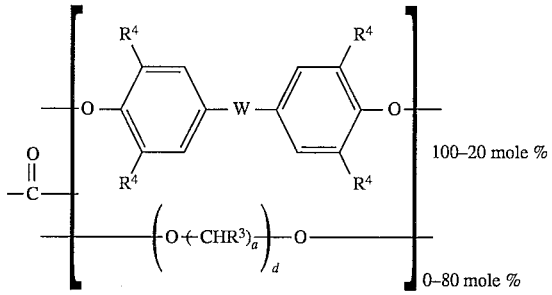

wherein $R^3$ represents hydrogen, methyl or ethyl;

$R^4$ repesents hydrogen, alkyl of 1 to 6 carbon atoms or halogen;

a represents an integer from 2 to 10;

d is an integer from 1 to 6; and

W represents

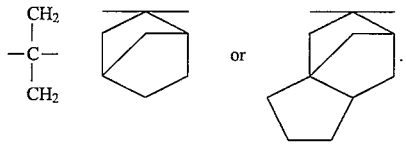

9. The process of claim 8 wherein the block polysiloxane units of the linear condensation copolymer are derived from functional group terminated polysiloxanes of the following formula (I):

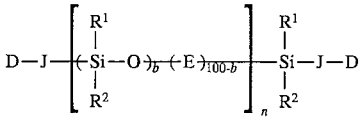

(I)

wherein:

$R^1$ and $R^2$ are each independently substituted or unsubstituted alkyl of from 1 to 6 carbon atoms, or substituted or unsubstituted phenyl, with the proviso that $R^1$ and $R^2$ are not both phenyl;

J is a bivalent linking group;

D is amino, hydroxyl, or thiol;

E represents optional second siloxane units which may be diphenyl substituted or oxyalkylene containing units;

b represents 50 to 100 mole percent; and n is chosen such as to provide a molecular weight of from about 1,000 to 30,000 for the polysiloxane block unit.

10. The process of claim 9 wherein said linear condensation copolymer is of the following formula (II):

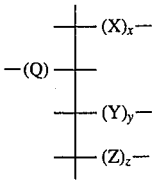

(II)

wherein:

Q represents linkage units which together with units X, Y and Z form ester type linkage units or amide type linkage units;

X is derived from one or more non-phenolic diol units, present at x= 0 to 99.9 mole %;

Y is derived from an aromatic diphenolic unit, present at y=0 to 99.9 mole %;

Z is derived from the polysiloxane of formula (I) present at z=0.1 to 10.0 mole %; and x+y+z=100.

11. The process of claim 10 wherein the linear condensation copolymer is a polycarbonate.

12. The process of claim 8 wherein $R^3$ and $R^4$ are both hydrogen, a is 2 and d is 2.

13. The process of claim 8 wherein W is $—C(CH_3)_2—$.

14. The process of claim 8 wherein the ratio of said linear condensation copolymer to said polycarbonate is from about 5:1 to about 1:5.

15. A thermal dye transfer assemblage comprising: (a) a dye-donor element comprising a support having thereon a dye layer, and (b) a dye-receiving element comprising a support having thereon, in order, a dye image-receiving layer and an overcoat layer, said dye-receiving element being in a superposed relationship with said dye-donor element so that said dye layer is in contact with said dye image-receiving layer, said overcoat layer comprising:

a) a linear condensation copolymer containing block polysiloxane units copolymerized into a linear polymer chain, said linear copolymer comprising from about 1 to about 40 wt. % of polysiloxane units; and b) a polycarbonate having a Tg of from about 10° C. to about 120° C. and a molecular weight of from about 1,000 to about 6,000, said polycarbonate having the following formula:

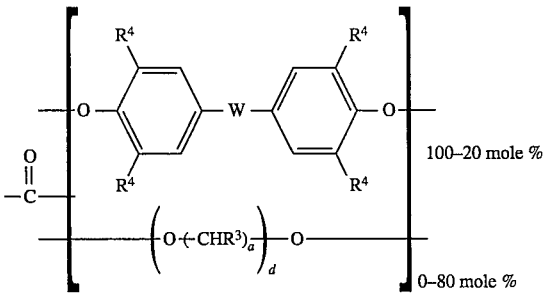

wherein $R^3$ represents hydrogen, methyl or ethyl;

$R^4$ repesents hydrogen, alkyl of 1 to 6 carbon atoms or halogen;

a represents an integer from 2 to 10;

d is an integer from 1 to 6; and

W represents

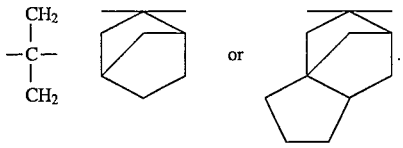

16. The assemblage of claim 15 wherein the block polysiloxane units of the linear condensation copolymer are derived from functional group terminated polysiloxanes of the following formula (I):

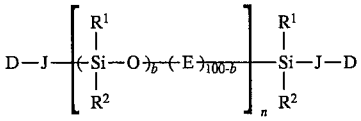

(I)

wherein:

$R^1$ and $R^2$ are each independently substituted or unsubstituted alkyl of from 1 to 6 carbon atoms, or substituted or unsubstituted phenyl, with the proviso that $R^1$ and $R^2$ are not both phenyl;

J is a bivalent linking group;

D is amino, hydroxyl, or thiol;

E represents optional second siloxane units which may be diphenyl substituted or oxyalkylene containing units;

b represents 50 to 100 mole percent; and n is chosen such as to provide a molecular weight of from about 1,000 to 30,000 for the polysiloxane block unit.

17. The assemblage of claim 16 wherein said linear condensation copolymer is of the following formula (II):

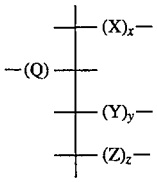

(II)

wherein:

Q represents linkage units which together with units X, Y and Z form ester type linkage units or amide type linkage units;

X is derived from one or more non-phenolic diol units, present at x=0 to 99.9 mole %;

Y is derived from an aromatic diphenolic unit, present at y=0 to 99.9 mole %;

Z is derived from the polysiloxane of formula (I) present at z=0.1 to 10.0 mole %; and x+y+z=100.

18. The assemblage of claim 17 wherein the linear condensation copolymer is a polycarbonate.

19. The assemblage of claim 15 wherein $R^3$ and $R^4$ are both hydrogen, a is 2, d is 2 and W is $—C(CH_3)_2—$.

20. The assemblage of claim 15 wherein the ratio of said linear condensation copolymer to said polycarbonate is from about 5:1 to about 1:5.

* * * * *